US006755505B2

(12) United States Patent
Liu et al.

(10) Patent No.: US 6,755,505 B2
(45) Date of Patent: Jun. 29, 2004

(54) CARRIAGE DAM FOR INKJET PRINTER

(75) Inventors: Kan Liu, San Diego, CA (US); Jaren D Marler, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/874,424

(22) Filed: Jun. 4, 2001

(65) Prior Publication Data

US 2002/0180829 A1 Dec. 5, 2002

(51) Int. Cl.[7] ..... B41J 23/00

(52) U.S. Cl. ..... 347/37; 347/33; 347/34; 347/36

(58) Field of Search ..... 347/34, 47, 22, 347/44, 40, 43, 36, 33

(56) References Cited

U.S. PATENT DOCUMENTS 3,983,801 A 10/1976 Watanabe et al.
4,077,040 A 2/1978 Hendriks
4,369,450 A 1/1983 Iwagami et al.
4,411,706 A * 10/1983 Wallace et al. ..... 134/37
4,520,366 A 5/1985 Cragin, Jr.
4,591,869 A 5/1986 Katerberg et al.
4,940,998 A * 7/1990 Asakawa ..... 347/37
5,625,398 A 4/1997 Milkovits et al.
5,774,141 A 6/1998 Cooper et al.
5,877,788 A 3/1999 Haan et al.
6,203,152 B1 3/2001 Boleda et al.

* cited by examiner

*Primary Examiner*—Stephen D. Meier
*Assistant Examiner*—Ly T Tran

(57) ABSTRACT

A fluid ejection system includes a plurality of cartridges each including a fluid ejection device, and a carriage adapted to hold the cartridges. The carriage includes a carriage darn including a plurality of openings and a plurality of panels. Each of the openings accommodate one of the cartridges, and each of the panels have a surface oriented substantially parallel with a front face of the fluid ejection device 0° F. the one of the cartridges and at least one substantially straight edge extending substantially completely along a side of the one of the cartridges.

44 Claims, 5 Drawing Sheets

CARRIAGE DAM FOR INKJET PRINTER

THE FIELD OF THE INVENTION

The present invention relates generally to inkjet printers, and more particularly to an inkjet printer including a carriage dam which controls the accumulation of the ink aerosol in the inkjet printer during printer.

BACKGROUND OF THE INVENTION

As illustrated in FIG. 1, a portion of a conventional inkjet printer 90 includes a printer carriage 91 and a plurality of print cartridges 92 installed in the printer carriage. Each print cartridge includes a printhead 93 which ejects or fires ink drops 94 through a plurality of orifices or nozzles 95 and toward a print medium 96, such as a sheet of paper, so as to print a dot of ink on the print medium. Typically, the orifices are arranged in one or more columns or arrays such that properly sequenced ejection of ink from the orifices causes characters or other images to be printed upon the print medium as the print cartridge and the print medium are moved relative to each other. In one arrangement, the print medium is supported by a platen or roller 97 as the print cartridge traverses the print medium to create a band or swath of print on the print medium.

During printing, the ink drops generate a fine mist or fog of relatively small ink particles 98 suspended in air. Unfortunately, these small ink particles, referred to as ink aerosol, can accumulate on components of the inkjet printer and cause functional failures and/or cosmetic defects. The ink aerosol, for example, can cause corrosion of electrical contacts or traces of the print cartridges which, in turn, can lead to failure of the print cartridges. In addition, the ink aerosol can accumulate, for example, on the sides of the print cartridges such that when a user of the inkjet printer attempts to remove one or more of the print cartridges from the printer carriage, the accumulated ink aerosol is transferred onto the hands of the user thereby creating a messy operation.

The ink aerosol can also accumulate on media transport surfaces of the inkjet printer and be transferred to the print medium such that the print medium is marked or marred during printing. For example, when the printer carriage and print cartridges traverse the print medium during printing, the printer carriage may move beyond the edge of the print medium. As such, ink aerosol can accumulate on the platen or roller of the inkjet printer. Thus, when a subsequent sheet of print medium is routed through the inkjet printer, ink aerosol accumulated on the platen or roller may be transferred to the print medium.

Accordingly, a need exists for an inkjet printer which controls the accumulation of ink aerosol, generated during printing, on components of the inkjet printer.

SUMMARY OF THE INVENTION

One aspect of the present invention provides a fluid ejection system which includes a plurality of cartridges each including a fluid ejection device, and a carriage adapted to hold the cartridges. The carriage includes a carriage darn including a plurality of openings and a plurality of panels. Each of the openings accommodate one of the cartridges, and each of the panels have a surface oriented substantially parallel with a front bite of the fluid ejection device of the one of the cartridges and at least one substantially straight edge extending substantially completely along a side of the one of the cartridges.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "left," "right," "leading," "trailing," etc., is used with reference to the orientation of the Figure(s) being described. The inkjet printer and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 2:
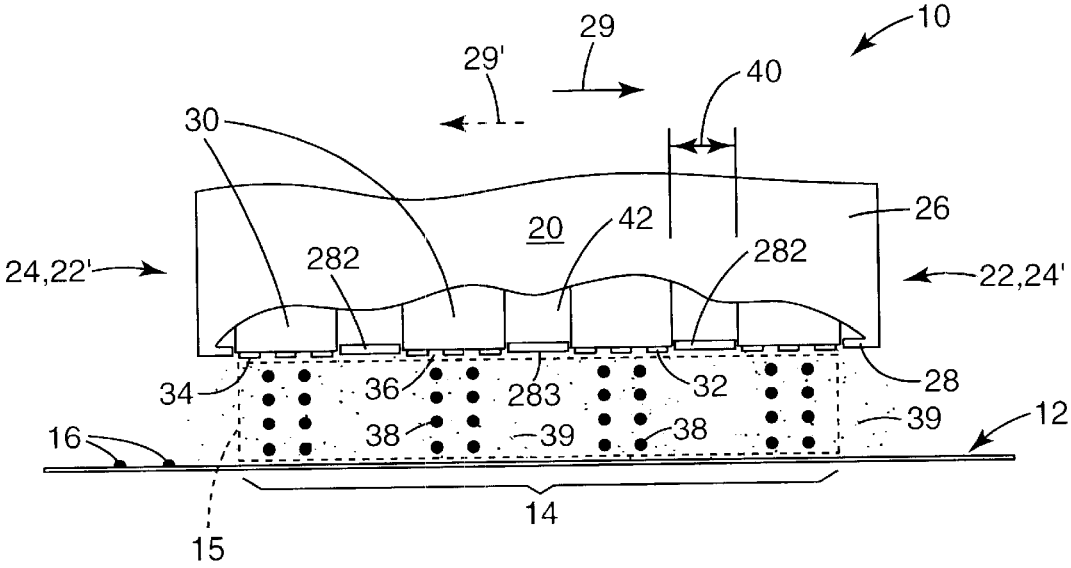
FIG. 2 is a side schematic view of one embodiment of a portion of an inkjet printer including a carriage dam according to the present invention.
Figure 3:
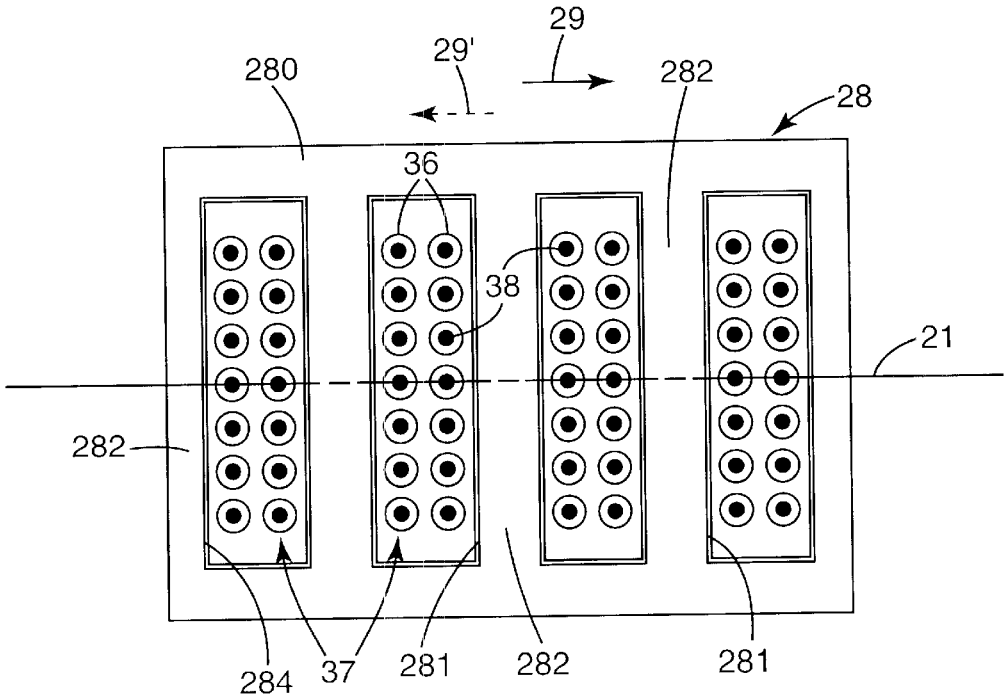
FIG. 3 is a bottom schematic view of the inkjet printer of FIG. 2.

FIGS. 2 and 3 illustrate one embodiment of a portion of an inkjet printer 10 for printing on a print medium 12. Inkjet printer 10 includes a printer carriage 20 and a plurality print cartridges 30. Print medium 12 includes a print region 14 within which print 16 in the form of characters and/or graphics is created as relative movement between print cartridges 30 and print medium 12 occurs during printing. Print medium 12 is any type of suitable material, such as paper, cardstock, transparencies, Mylar, and the like.

During printing, print medium 12 is held stationary as printer carriage 20 and print cartridges 30 move in a printing direction, as indicated by arrow 29, to traverse print medium 12 and create print 16. Upon completing a row of print 16, print medium 12 is advanced in a direction substantially perpendicular to the printing direction indicated by arrow 29 (i.e., in and out of the plane of the paper). Thereafter, print medium 12 is held stationary as printer carriage 20 and print cartridges 30 move in a printing direction, as indicated by arrow 29', opposite the printing direction indicated by arrow 29, to traverse print medium 12 and create another row of print 16.

Printer carriage 20 is slidably supported within a housing (not shown) of inkjet printer 10 for travel back and forth across print medium 12, and print cartridges 30 are installed in printer carriage 20 for movement with printer carriage 20 during printing. Printer carriage 20, including print cartridges 30, has a scan axis 21 along which printer carriage 20 and, therefore, print cartridges 30 traverse during printing.

Print cartridges 30 each include a printhead 32 having a front face 34 in which a plurality of ink orifices or nozzles 36 are formed in a manner well known to those skilled in the art. It is understood that printhead 32 may include one or more columns or other arrays of ink orifices 36. In one embodiment, ink orifices 36 of printhead 32 are arranged in one or more columns 37. As such, each column 37 of ink orifices 36 is oriented substantially perpendicular to scan axis 21.

Example embodiments of printhead 32 include a thermal printhead, a piezoelectric printhead, a flex-tensional printhead, or any other type of inkjet ejection device known in the art. If printhead 32 is, for example, a thermal printhead, printhead 32 typically includes a substrate layer (not shown) having a plurality of resistors (not shown) which are operatively associated with ink orifices 36. Upon energization of the resistors, in response to command signals delivered by a controller (not shown) to a respective print cartridge 30, drops of ink 38 are ejected through ink orifices 36 toward print medium 12.

Print cartridges 30 may eject the same or differing colors of ink drops 38 during printing. In addition, all or less than all print cartridges 30 may be operated at one time. While inkjet printer 10 is illustrated as including four print cartridges 30, it is within the scope of the present invention for inkjet printer 10 to include any number of print cartridges 30.

Figure 1:
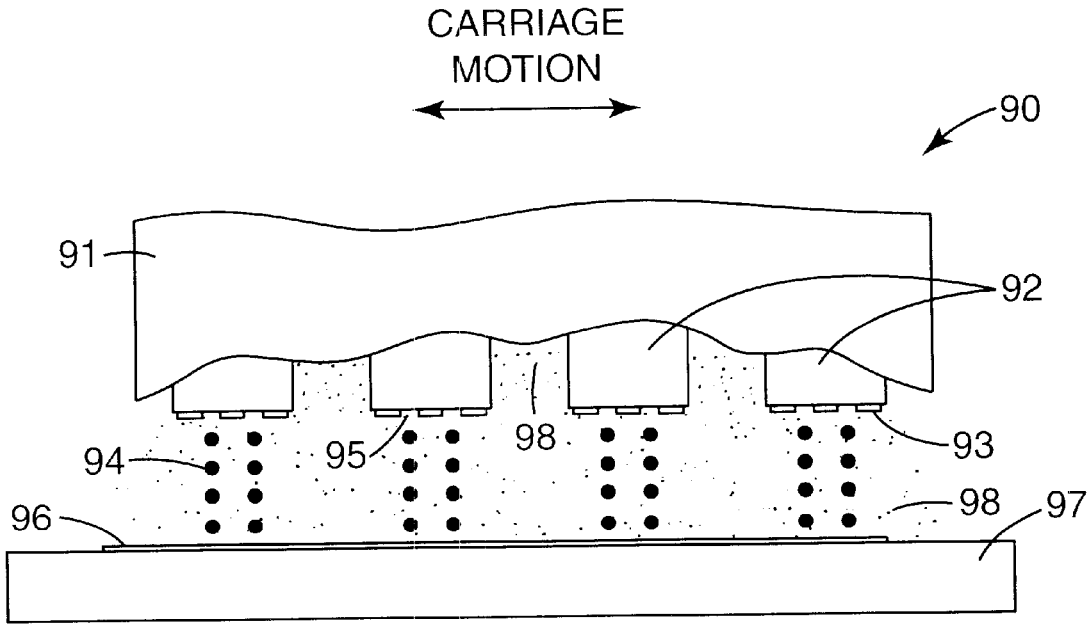
Fig. 1 PRIOR ART
FIG. 1 is a side schematic view of a portion of a prior art inkjet printer.

Ink drops 38 are ejected through ink orifices 36 and from printhead 32 into a print zone 15 with an intended ink drop trajectory. Print zone 15 is defined as being between printhead 32 and print medium 12, and encompasses ink drops 38. As such, print zone 15, as well as print region 14 of print medium 12, move with print cartridges 30 during printing. In one embodiment, ink drops 38 generate ink aerosol 39 in the form of a fine mist or fog of relatively small ink particles suspended in air. It is understood that the representation of ink aerosol 39, as illustrated in FIG. 1, for example, has been exaggerated for clarity of the invention.

Printer carriage 20 has a leading end 22 and a trailing end 24 when printer carriage 20 moves along scan axis 21 in the printing direction indicated by arrow 29 and a leading end 22' and a trailing end 24' when printer carriage 20 moves along scan axis 21 in the printing direction indicated by arrow 29', opposite the printing direction indicated by arrow 29. In addition, since print cartridges 30 and, therefore, printhead 32 are installed in printer carriage 20 for movement with printer carriage 20 during printing, scan axis 21 represents a scan axis of print cartridges 30.

In one embodiment, printer carriage 20 includes a carriage shell 26 and a carriage dam 28. Carriage shell 26 is configured to hold print cartridges 30 and is mounted in inkjet printer 10 for lateral movement relative to print medium 12. As such, carriage shell 26 supports print cartridges 30 for movement back and forth across print medium 12. Thus, carriage shell 26 and print cartridges 30 traverse print medium 12 along scan axis 21.

Carriage dam 28 is joined to carriage shell 26 and extends between leading end 22 of printer carriage 20 and trailing end 24 of printer carriage 20. In one embodiment, carriage dam 28 includes a plate 280 which extends between leading end 22 of printer carriage 20 and trailing end 24 of printer carriage 20. In one embodiment, carriage dam 28 is formed integrally with carriage shell 26. In another embodiment, however, carriage dam 28 is formed separately from carriage shell 26. As such, carriage dam 28 is secured or attached to carriage shell 26 for movement with carriage shell 26 during printing.

Plate 280 has a plurality of openings 281 defined therein. Openings 281 are each sized and configured to accommodate one print cartridge 30 such that printhead 32 of a respective print cartridge 30 is accessible and/or extends through a respective opening 281. Openings 281 are spaced laterally from each other along scan axis 21 such that carriage dam 28 includes a plurality of panels 282 each formed by a portion of plate 280 adjacent to one or more openings 281 in plate 280.

Plate 280 and, more specifically, panels 282 form a surface 283 of carriage dam 28 which is oriented substantially parallel with front face 34 of printhead 32 of print cartridges 30 when print cartridges 30 are supported by carriage shell 26. As such, surface 283 of carriage dam 28 is oriented substantially parallel with print region 14 of print medium 12 during printing.

Preferably, panels 282 of carriage dam 28 are each positioned laterally of and adjacent to print cartridges 30 when print cartridges 30 are supported by carriage shell 26. As such, panels 282 are positioned and extend between adjacent print cartridges 30. Panels 282 each have at least one edge 284 which is oriented substantially perpendicular to scan axis 21. In addition, edge 284 of each panel 282 is oriented substantially parallel with column 37 of ink orifices 36 of adjacent print cartridges 30.

In one embodiment, printer carriage 20 and, more specifically, carriage shell 26 supports and/or holds print cartridges 30 such that a gap 40 is formed between adjacent print cartridges 30. As such, a pocket 42 is formed between adjacent print cartridges 30. Preferably, panels 282 of carriage dam 28 substantially block gap 40 between adjacent print cartridges 30. As such, pocket 42 between adjacent print cartridges 30 is substantially closed by carriage dam 28.

During printing, as described above, printer carriage 20 and, therefore, print cartridges 30 traverse print medium 12 in the printing directions indicated by arrows 29 and 29'. As such, ink drops 38 are ejected from printhead 32 of one or more print cartridges 30. As ink drops 38 are ejected during printing, ink aerosol 39 is generated. Thus, with carriage dam 28, ink aerosol 39 accumulates on surface 283 of panels 282 of carriage dam 28. Ink aerosol 39, therefore, accumulates on carriage dam 28 rather than print cartridges 30.

Figure 4:
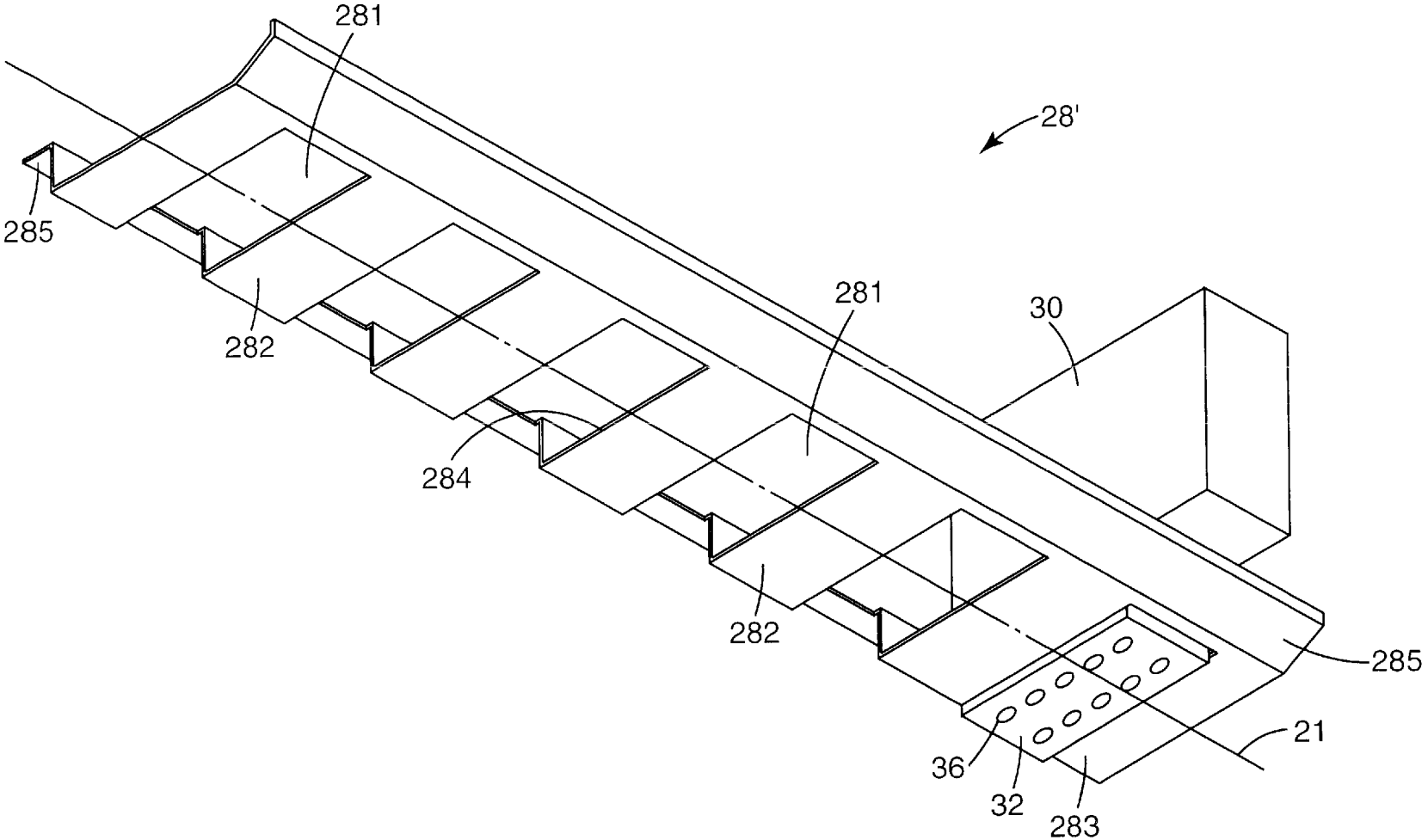
FIG. 4 is a bottom perspective view of one embodiment of a carriage dam according to the present invention.
Figure 5:
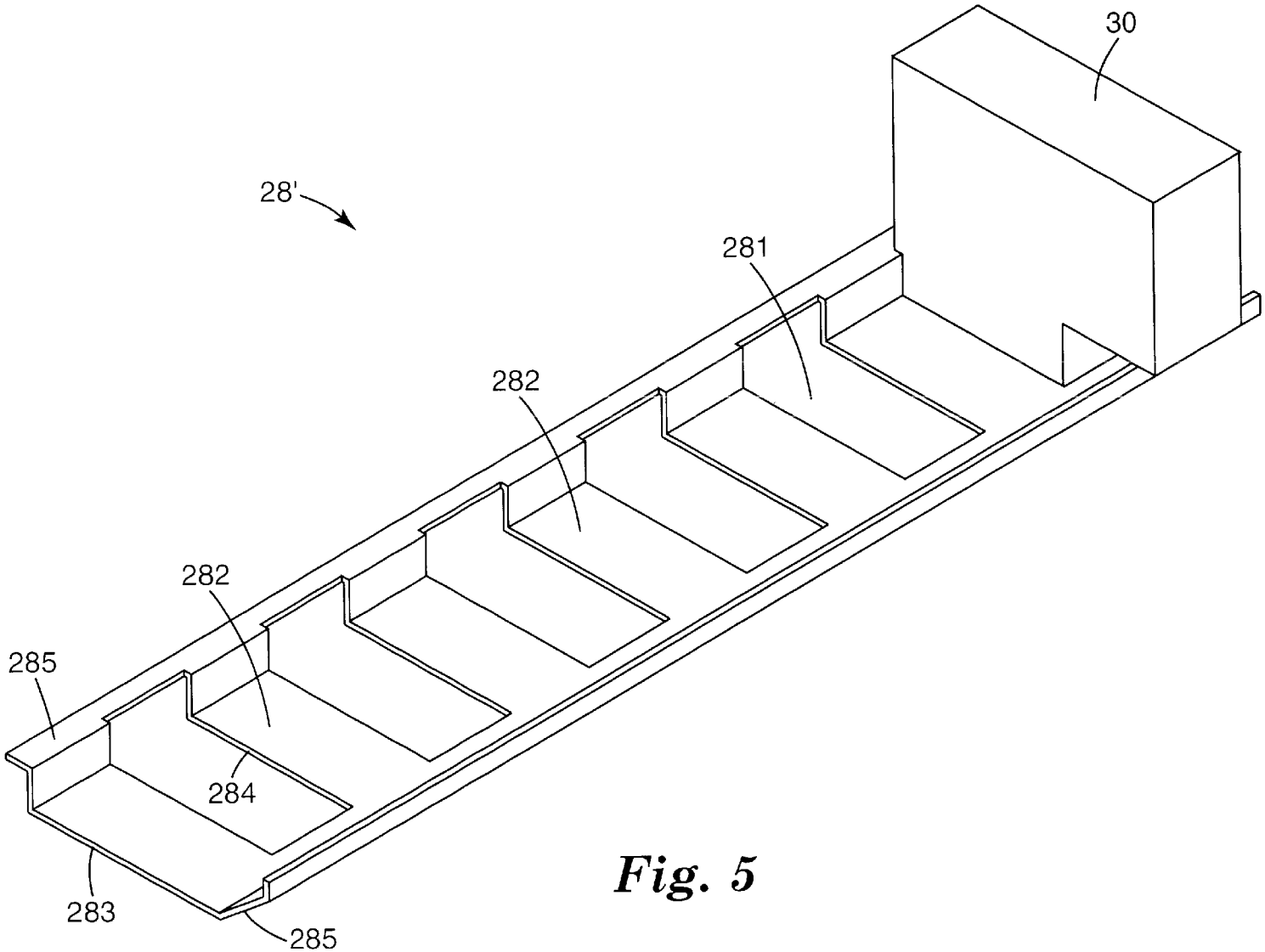
FIG. 5 is a top perspective view of the carriage dam of FIG. 4.

FIGS. 4 and 5 illustrate another embodiment of carriage dam 28. Carriage dam 28', similar to carriage dam 28, accommodates a plurality of print cartridges 30 (only one of which is illustrated in the drawings). Reference herein to carriage dam 28, therefore, is also applicable to carriage dam 28'. While carriage dam 28' is illustrated as accommodating six print cartridges 30, it is within the scope of the present invention for inkjet printer 10 to include any number of print cartridges 30 and, therefore, for carriage dam 28' to accommodate any number of print cartridges 30.

In one embodiment, carriage dam 28' includes a pair of rails 285 which extend between leading end 22 of printer carriage 20 and trailing end 24 of printer carriage 20 when carriage dam 28' is joined to carriage shell 26. Rails 285 are spaced from each other in a direction substantially perpendicular to scan axis 21 of printer carriage 20. As such, panels 282 of carriage dam 28' extend between rails 285 and are spaced laterally from each other along scan axis 21 to form openings 281 which accommodate print cartridges 30. Preferably, rails 285 are oriented substantially parallel with scan axis 21 of printer carriage 20. In addition, panels 282 of carriage dam 28' extend between rails 285 in a direction substantially perpendicular to scan axis 21.

Figure 6:
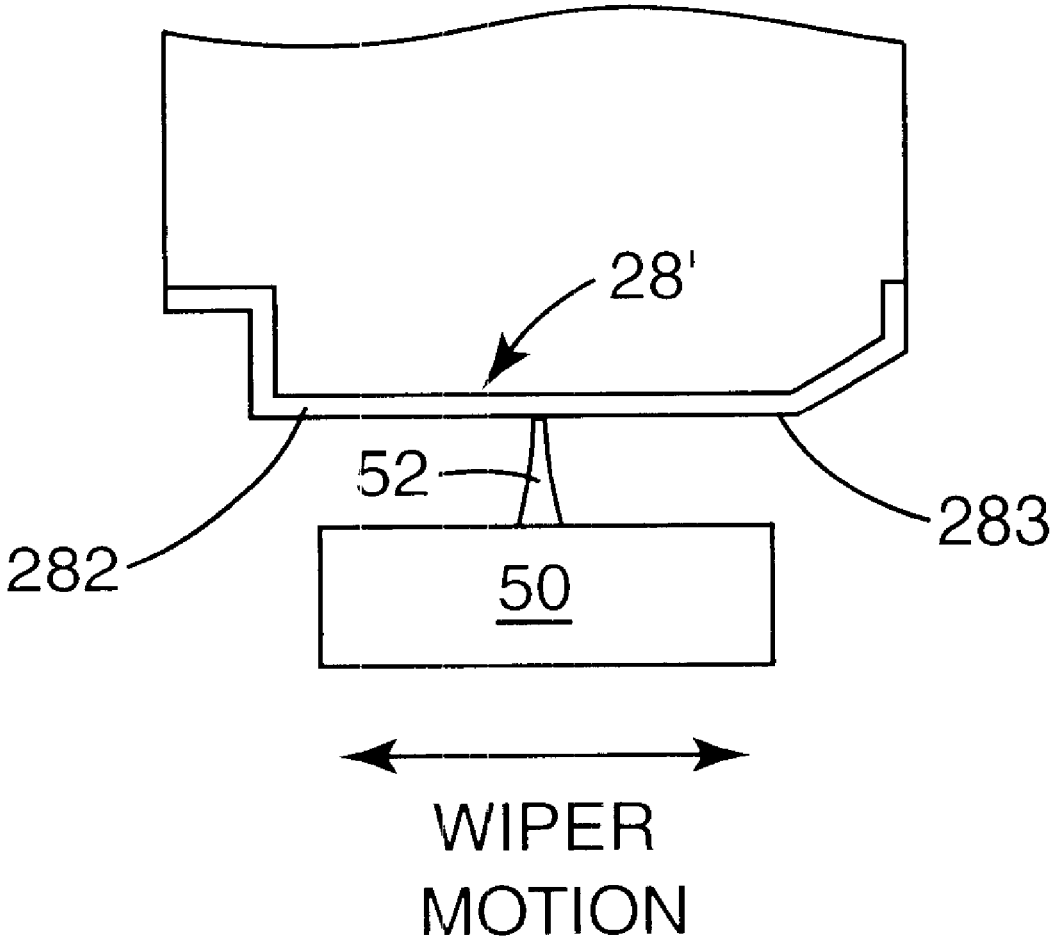
FIG. 6 is a side schematic view of one embodiment of a portion of a service station assembly interacting with a portion of the carriage dam of FIG. 4.

In one embodiment, as illustrated in FIG. 6, inkjet printer 10 includes a service station assembly 50. Service station assembly 50, as is known in the art, includes a rubber blade or wiper 52 which is periodically passed over printhead 32 of a respective print cartridge 30 to wipe and clean front face 34 and, therefore, ink orifices 36 of excess ink. Thus, with carriage dam 28, wiper 52, as illustrated in FIG. 6, may be periodically passed over a respective panel 282 of carriage dam 28 to wipe and clean surface 283 of panel 282 of ink aerosol 39.

By providing printer carriage 20 with carriage dam 28, carriage dam 28 controls the accumulation of ink aerosol 39 in inkjet printer 10. More specifically, panels 282 of carriage dam 28 block gaps 40 between adjacent print cartridges 30 and close pockets 42 formed between adjacent print cartridges 30. As such, ink aerosol 39 generated during printing accumulates on carriage dam 28 and, more specifically, panels 282 of carriage dam 28 rather than print cartridges 30. Thus, wiper 52 of service station assembly 50 may be used to remove accumulated ink aerosol 39 from surface 283 of panels 282. Surface 283 of panels 282, therefore, provides a serviceable surface of carriage dam 28.

By blocking gaps 40 between adjacent print cartridges 30, carriage dam 28 reduces or eliminates the accumulation of ink aerosol 39 on, for example, the sides of print cartridges 30. Thus, potential functional failures caused by the accumulation of ink aerosol on, for example, electrical contacts provided on the sides of print cartridges 30 are avoided. In addition, the mess created by the accumulation of ink aerosol on the sides of print cartridges 30 is avoided. Furthermore, by closing pockets 42 between adjacent print cartridges 30, carriage dam 28 reduces an amount of free-floating ink aerosol 39 in inkjet printer 10 by reducing areas where ink aerosol 39 can drift. Thus, by providing carriage dam 28, ink aerosol 39 accumulates on carriage dam 28 rather than floating freely within inkjet printer 10 and accumulating on other components of inkjet printer 10 such as a platen or roller of inkjet printer 10. Carriage dam 28, therefore, controls the accumulation of ink aerosol 39 in inkjet printer 10 during printing.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printer, comprising: a plurality of print cartridges each including a printhead having a plurality of ink orifices formed in a front face thereof; and a printer carriage adapted to hold the print cartridges and traverse a scan axis, wherein the printer carriage includes a carriage darn including a plurality of openings and a plurality of panels, each of the openings accommodating one of the print cartridges, and each of the panels having a surface oriented substantially parallel with the front face of the printhead of the one of the print cartridges, wherein each of the openings are defined by a substantially straight edge extending directly adjacent the one of the print cartridges and along a side of the one of the print cartridges adjacent the printhead of the one of the print cartridges from one end to an opposite end of the printhead, wherein the substantially straight edge is substantially uniformly spaced from the side of the one of the print cartridges from the one end to the opposite end of the printhead.

2. The inkjet printer of claim 1, wherein one of the panels of the carriage darn is positioned and extends between adjacent ones of the print cartridges.

3. The inkjet printer of claim 1, wherein the printer carriage is adapted to bold the print cartridges with a gap between adjacent ones of the print cartridges, and wherein one of the panels of the carriage darn is adapted to substantially block the gap between the adjacent ones of the print cartridges.

4. The inkjet printer of claim 1, wherein the plurality of ink orifices of the printhead of each of the print cartridges form at least one column of ink orifices, and wherein the substantially straight edge of each of the openings is oriented substantially parallel with the at least one column of ink orifices of an adjacent one of the print cartridges.

5. The inkjet printer of claim 4, wherein the substantially straightedge of each of the openings is oriented substantially perpendicular to the scan axis.

6. The inkjet printer of claim 1, wherein the carriage dam includes a plate having the plurality of openings defined therein, wherein each of the panels OF the carriage dam are formed by a portion of the plate adjacent at least one of the openings in the plate.

7. The inkjet printer of claim 6, wherein the printer carriage has a first end in a direction of the scan axis and a second end opposite the first end, and wherein the plate of the carriage dam extends between the first end and the second end of the printer carriage.

8. The inkjet printer of claim 1, wherein the card age dam includes a pair of spaced rails, and wherein the panels of the carriage dam extend between the spaced rails and are spaced laterally from each other along the scan axis to accommodate one of the print cartridges therebetween.

9. The inkjet printer of claim 8, wherein each of the panels extend between the spaced rails in a direction substantially perpendicular to the scan axis.

10. The inkjet printer of claim 9, wherein the pair of spaced rails are oriented substantially parallel with the scan axis.

11. The inkjet printer of claim 1, wherein the substantially straight edge of each of the openings includes an edge of the surface of each of the opening oriented substantially parallel with the front face of the printhead of the one of the print cartridges.

12. A printer carriage adapted to hold a plurality of print cartridges of an inkjet printer, each of the print cartridges including a printhead having a plurality of ink orifices formed in a front face thereof, the printer carriage comprising:

a carriage shell adapted to support the print cartridges for movement along a scan axis; and a carriage dam joined to the carriage shell and including a plurality of panels spaced laterally from each other along the scan axis to form a plurality of openings therebetween, wherein each of the openings are adapted to accommodate one of the print cartridges, and wherein each of the panels are configured to have a surface oriented substantially parallel with the front face of the printhead of the one of the print cartridges, wherein each of the openings are defined by a substantially straight edge configured to extend directly adjacent the one of the print cartridges and along a side of the one of the print cartridges adjacent the printhead of the one of the print cartridges from one end to an opposite end of the printhead when the one of the print cartridges is supported by the carriage shell, wherein the substantially straight edge is configured to be substantially uniformly spaced from the side of the one of the print cartridges from the one end to the opposite end of the printhead.

13. The punter carriage of claim 12, wherein one of the panels of the carriage dam is adapted to be positioned and extend between adjacent ones or the print cartridges when the print cartridges are supported by the carriage shell.

14. The inter carriage of claim 12, wherein the carriage shell is adapted to support the print cartridges with a gap between adjacent ones of the print cartridges, and wherein one of the panels of the carriage dam is adapted to substantially block the gap between the adjacent ones of the print cartridges when the print cartridges are supported by the carriage shell.

15. The printer carriage of claim 12, wherein the plurality of ink orifices of the printhead of each of the print cartridges form at least one column of ink orifices, and wherein the substantially straight edge of each of the openings is configured to be oriented substantially parallel with the at least one column of ink orifices of an adjacent one of the print cartridges when the print cartridges are supported by the carriage shell.

16. The printer carriage of claim 15, wherein the substantially straight edge of each of the openings is oriented substantially perpendicular to the scan axis.

17. The printer carriage of claim 12, wherein the carriage darn includes a plate having the plurality of openings defined therein, wherein each of the panels of the carriage darn are formed by a portion of the plate adjacent at least one of the openings in the plate.

18. The printer carriage of claim 17, wherein the carriage shell has a first end in a direction of the scan axis and a second end opposite the first end, and wherein the plate of the carriage dam extends between the first end and the second end of the carriage shell.

19. The printer carriage of claim 12, wherein the carriage dam includes a pair of spaced rails, and wherein the panels of the carriage dam extend between the spaced rails.

20. The printer carriage of claim 19, wherein each of the panels extend between the spaced rails in a direction substantially perpendicular to the scan axis.

21. The printer carriage of claim 20, wherein the pair of spaced rails are oriented substantially parallel with the scan axis.

22. A method of forming a printer carriage for a plurality of print cartridges of an inkjet printer, each of the print cartridges including a printhead having a plurality of ink orifices formed in a front face thereof, the method comprising the steps of:

providing a carriage shell adapted to support the print cartridges for movement along a scan axis; and joining a carriage dam with the carriage shell, including laterally spacing a plurality of panels from each other along the scan axis and forming a plurality of openings therebetween, wherein each of the openings are adapted to accommodate one of the print cartridges, and wherein each of the panels are configured to have a surface oriented substantially parallel with the front face of the printhead of the one of the print cartridges, wherein each of the openings are defined by a substantially straight edge configured to extend directly adjacent the one of the print cartridges and along a side of the one of the print cartridges adjacent the printhead of the one of the print cartridges from one end to an opposite end of the printhead when the one of the print cartridges is supported by the carriage shell, wherein the substantially straight edge is configured to be substantially uniformly spaced from the side of the one of the print cartridges from the one end to the opposite end of the printhead.

23. The method of claim 22, wherein laterally spacing the panels from each other includes configuring at least one of the panels to be positioned and extend between adjacent ones or the print cartridges when the print cartridges are supported by the carriage shell.

24. The method of claim 22, wherein laterally spacing the panels from cacti other includes configuring the panels to substantially block a gap between adjacent ones of the print cartridges when the print cartridges are supported by the carriage shell.

25. The method of claim 22, wherein laterally spacing the panels from each other includes configuring at least one edge of each of the panels to be oriented substantially parallel with at least one column of the ink orifices of an adjacent one of the print cartridges when the print cartridges are supported by the carriage shell.

26. The method of claim 22, wherein laterally spacing the panels from each other includes orienting at least one edge of each of the panels substantially perpendicular to the scan axis.

27. The method of claim 22, wherein the step of joining the cartage darn with the carriage shell includes joining a plate having the plurality of openings defined therein with the carriage shell and forming each of the panels of the carriage dam with a portion of the plate adjacent at least one of the openings defined in the plate.

28. The method of claim 22, wherein the step of joining the carriage darn with the carriage shell includes joining a pair of spaced rails with the carriage shell, including orienting the spaced rails substantially parallel with the scan axis, wherein laterally spacing the panels from each other includes extending the panels between the spaced rails.

29. The method of claim 28, wherein extending the panels between the spaced rails includes extending each of the panels between the spaced rails in a direction substantially perpendicular to the scan axis.

30. A method of printing on a print medium with an inkjet printer including a plurality of print cartridges each including a printhead having a plurality of ink orifices formed in a front face thereof, the method comprising:

supporting the print cartridges in a carriage shell and traversing the print medium with the print cartridges along a scan axis;

ejecting ink drops through the ink orifices of the printhead of at least one of the print cartridges and toward the print medium, including generating ink aerosol of the ink drops; and collecting the ink aerosol on a carnage darn joined to the carriage shell and including a plurality of openings each accommodating one of the print cartridges and a plurality of panels each having a surface oriented substantially parallel with the front face of the printhead of the one of the print cartridges, wherein each of the openings are defined by a substantially straight edge extending directly adjacent the one of the print cartridges and along a side of the one of the print cartridges adjacent the printhead of the one of the print cartridges from one end to an opposite end of the printhead, wherein the substantially straight edge is substantially uniformly spaced from the side of the one of the print cartridges from the one end to the opposite end of the printhead, wherein collecting the ink aerosol on the carriage dam includes collecting at least a portion of the ink aerosol on at least one of the panels of the carriage dam.

31. The method of claim 30, wherein collecting the ink aerosol on the at least one of the panels of the carriage dam includes collecting the ink aerosol on the surface of the at least one of the panels oriented substantially parallel with the front face of the printhead of the one of the print cartridges.

32. The method of claim 31, further comprising:

removing the ink aerosol collected on the at least one of the panels from the surface of the at least one of the panels.

33. The method of claim 32, wherein removing the ink aerosol includes wiping the surface of the at least one of the panels in a direction substantially perpendicular to the scan axis.

34. A carriage adapted to hold a plurality of cartridges of a fluid ejection system, each of the cartridges including a fluid ejection device, the carriage comprising:

a carriage shell adapted to support the cartridges for movement along a scan axis; and a carriage dam joined to the carriage shell and including a plurality of panels spaced laterally from each other along the scan axis to form a plurality of openings therebetween, wherein each of the openings are adapted to accommodate one of the cartridges, and wherein each of the panels are configured to have a surface oriented substantially parallel with a front face of the fluid ejection device of the one of the cartridges, wherein each of the openings are defined by a substantially straight edge configured to extend directly adjacent the one of the cartridges and along a side of the one of the cartridges adjacent the fluid ejection device of the one of the cartridges from one end to an opposite end of the fluid ejection device when the one of the cartridges is supported by the carriage shell, wherein the substantially straight edge is configured to be substantially uniformly spaced from the side of the one of the cartridges from the one end to the opposite end of the fluid ejection device.

35. The carriage of claim 34, wherein one of the panels of the carriage dam is adapted to be positioned and extend between adjacent ones of the cartridges when the cartridges are supported by the carriage shell.

36. The carriage of claim 34, wherein the carriage shell is adapted to support the cartridges with a gap between adjacent ones of the cartridges, and wherein one of the panels of the carriage darn is adapted to substantially block the gap between the adjacent ones of the cartridges when the cartridges are supported by the carriage shell.

37. The carriage of claim 34, wherein a plurality of ink orifices of the fluid ejection device of each of the cartridges form at least one column of ink orifices, and wherein the substantially straight edge of each of the plate openings is configured to be oriented substantially parallel with the at least one column of ink orifices of an adjacent one of cartridges when the cartridges are supported by the carriage shell.

38. The carriage of 37, wherein the substantially straight edge of each of the openings is oriented substantially perpendicular to the scan axis.

39. The carriage of claim 34, wherein the carriage dam includes a plate having the plurality of openings defined therein, wherein each of the panels of the carriage darn are formed by a portion of the plate adjacent at least one of the openings in the plate.

40. The carriage of claim 39, wherein the carriage shell has a first end in a direction of the scan axis and a second end opposite the first end, and wherein the plate of the carriage dam extends between the first end the second end of the carriage shell.

41. The carriage of claim 34, wherein the carriage dam includes a pair of spaced rails, and wherein the panels of the carriage darn extend between the spaced rails.

42. The carriage of claim 41, wherein each of the panels extend between the spaced rails in a direction substantially perpendicular to the scan axis.

43. The carriage of claim 42, wherein the pair of spaced rails are oriented substantially parallel with the scan axis.

44. The carriage of claim 34, wherein the substantially straight edge of each of the openings includes an edge of the surface of each of the panels configured to be oriented substantially parallel with the front face of the fluid ejection device of the one of the cartridges.

* * * * *

UNITED STATES PATENT AND TRADEMARK OFFICE

CERTIFICATE OF CORRECTION

PATENT NO. : 6,755,505 B2
DATED : June 29, 2004
INVENTOR(S) : Liu et al.

It is certified that error appears in the above-identified patent and that said Letters Patent is hereby corrected as shown below:

Title page,
Item [54] delete "CARRIAGE DAM FOR INKJET PRINTER" and insert in lieu thereof -- CARRIAGE DAM --;
Item [57], ABSTRACT,
Line 3, delete "darn" and insert in lieu thereof -- dam --;
Line 7, delete "0°F" and insert in lieu thereof -- of --;

Column 1,
Line 60, delete "darn" and insert in lieu thereof -- dam --;
Line 64, delete "bite" and insert in lieu thereof -- face --;

Column 6,
Line 8, delete "darn" and insert in lieu thereof -- dam --;
Line 11, delete "bold" and insert in lieu thereof -- hold
Line 13, delete "darn" and insert in lieu thereof -- dam
Line 27, delete "OF" and insert in lieu thereof -- of --;
Line 35, delete "card age" and insert in lieu thereof -- carriage --;

Column 7,
Line 10, delete "punter" and insert in lieu thereof -- printer --;
Line 12, delete "or" and insert in lieu thereof -- of --;
Line 14, delete "inter" and insert in lieu thereof -- printer --;
Line 33, delete "darn" and insert in lieu thereof -- dam
Line 35, delete "darn" and insert in lieu thereof-- dam --;

Column 8,
Line 31, delete "cartage darn" and insert in lieu thereof --carriage dam --;
Line 37, delete "darn" and insert in lieu thereof -- dam --;
Line 57, delete "carnage darn" and insert in lieu thereof -- carriage dam --;

UNITED STATES PATENT AND TRADEMARK OFFICE

CERTIFICATE OF CORRECTION

PATENT NO. : 6,755,505 B2
DATED : June 29, 2004
INVENTOR(S) : Liu et al.

It is certified that error appears in the above-identified patent and that said Letters Patent is hereby corrected as shown below:

Column 10,
Line 8, delete "darn" and insert in lieu thereof -- dam --;
Line 17, before "cartridges" insert -- the --;
Line 24, delete "darn" and insert in lieu thereof -- dam --;
Line 30, after "the first end" and before "the second end" and insert -- and --;
Line 34, delete "darn" and insert in lieu thereof -- dam --.

Signed and Sealed this

Fifth Day of October, 2004

JON W. DUDAS
*Director of the United States Patent and Trademark Office*